US011511282B2

(12) United States Patent
Breen et al.

(10) Patent No.: US 11,511,282 B2
(45) Date of Patent: Nov. 29, 2022

(54) AIR JACKETED BEAD BATH

(71) Applicants: Josiah Breen, Hillsboro, OR (US); Taylor Rassi, Oregon City, OR (US)

(72) Inventors: Josiah Breen, Hillsboro, OR (US); Taylor Rassi, Oregon City, OR (US)

( * ) Notice: Subject to any disclaimer, the term of this patent is extended or adjusted under 35 U.S.C. 154(b) by 269 days.

(21) Appl. No.: 17/068,805

(22) Filed: Oct. 12, 2020

(65) Prior Publication Data

US 2022/0111390 A1 Apr. 14, 2022

(51) Int. Cl.
*B01L 7/02* (2006.01)
*B01L 1/00* (2006.01)

(52) U.S. Cl.
CPC *B01L 7/02* (2013.01); *B01L 1/00* (2013.01); *B01L 2300/0627* (2013.01); *B01L 2300/1822* (2013.01); *B01L 2300/1844* (2013.01); *B01L 2300/1894* (2013.01)

(58) Field of Classification Search
None
See application file for complete search history.

(56) References Cited

U.S. PATENT DOCUMENTS 5,396,049 A * 3/1995 Knopf ..... A61L 2/04 219/385
2011/0311927 A1* 12/2011 Jarvis ..... F27D 99/00 432/9
2014/0251584 A1* 9/2014 Modisette, Jr. ..... F24H 9/0073 165/108

* cited by examiner

*Primary Examiner* — P. Kathryn Wright
(74) *Attorney, Agent, or Firm* — Mark S Hubert

(57) ABSTRACT

A laboratory sample/specimen temperature control device, specifically a metal bead bath that has its metal bead temperature controlled by a continuous flow of air into the bed of beads that is heated or cooled by a Peltier device that the air flows over. This provides great thermal uniformity across the bed of beads and constantly monitors and regulates the heat or cooling input rather than utilizing an on/off modulation temperature input approach.

6 Claims, 8 Drawing Sheets

AIR JACKETED BEAD BATH

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to the precision temperature control of a bead bath that is used for the maintenance of a specific temperature of any material immersed therein.

BACKGROUND

Bead baths, are commonly used in scientific research to maintain the temperature of materials immersed within their temperature controlled media. Beads replace water in non-circulating and non-shaking laboratory water baths as the beads are more resistant to bacterial growth and can be easily disinfected, therefore can help prevent the spreading of contamination throughout the lab. The beads baths use irregularly shaped bodies of dense materials, generally dry metals, with high coefficients of heat transfer, such as aluminum. The materials desired to be brought to or maintained at a specific temperature are immersed in the beads and by conduction they reach the same temperature as the beads in the bath. Because of the large propensity of the beds to retain their temperature, there are no large or quick swings in the temperature of the bead bath when the material's temperature is homogenized with the beads.

To date, these bead baths are maintained at their desired temperature by heating or cooling elements in contact with the bottom face of the basket the beads sit in. While this is a quick way of transmitting or removing heat form the beads, it is not the most efficient and it is prone to slight swings in temperature due to the speed of the energy transfer and the response times of the controlling electronics and sensors.

Thus, a more precise, gradual, temperature controllable for a dry metal bead bath, would fulfill a long felt need in laboratory environments. This new invention utilizes and combines known and new technologies in a unique and novel configuration to overcome the aforementioned problems and accomplish this.

BRIEF SUMMARY

In accordance with various embodiments, an air jacketed bead bath is provided where the primary transfer of heat to the metal beads from the bead bath is accomplished by convection, rather than the conventional method of conduction.

In one aspect, a metal bead bath designed for precise temperature control is provided.

In another aspect, a metal bead bath that has the temperature of its metal beads controlled by air that is heated or cooled by a Peltier device;

In yet another aspect, a controlled temperature environment for small samples where maintaining the desired temperature within 1/10 of a degree F. is possible.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

As used herein, the term "Peltier device" refers to a solid-state active heat pump which transfers heat from one side of the device to the other, with consumption of electrical energy, depending on the direction of the current. It is also referred to as a Peltier cooler, Peltier heater, or thermoelectric heat pump.

Current laboratory bead baths utilize beds of metal beads heated to a precise temperature by a heating or cooling element in contact with the bottom and/or sides of the basket the bed of beads sit in. While this is able to provide quick responses to temperature changes, it modulates on and off, and when it is on, it heats the bed of beads non uniformly from the bottom of the bed to the top or from the edges to the center. While these are capable of maintaining decent, quick temperature control, they are less precise and prone to slight temperature swings. This may not be suitable for extremely precise temperature situations, (I. E. within 1/10 of a degree C.) required in some scientific endeavors.

The present invention relates to a novel design for a laboratory sample/specimen temperature control device, specifically a metal bead bath that has its metal bead temperature controlled by a continuous flow of air into the bed of beads that is heated or cooled by a Peltier device that the air flows over. This provides great thermal uniformity across the bed of beads and constantly monitors and regulates the heat or cooling input rather than utilizing an on/off modulation temperature input approach.

Figure 1:
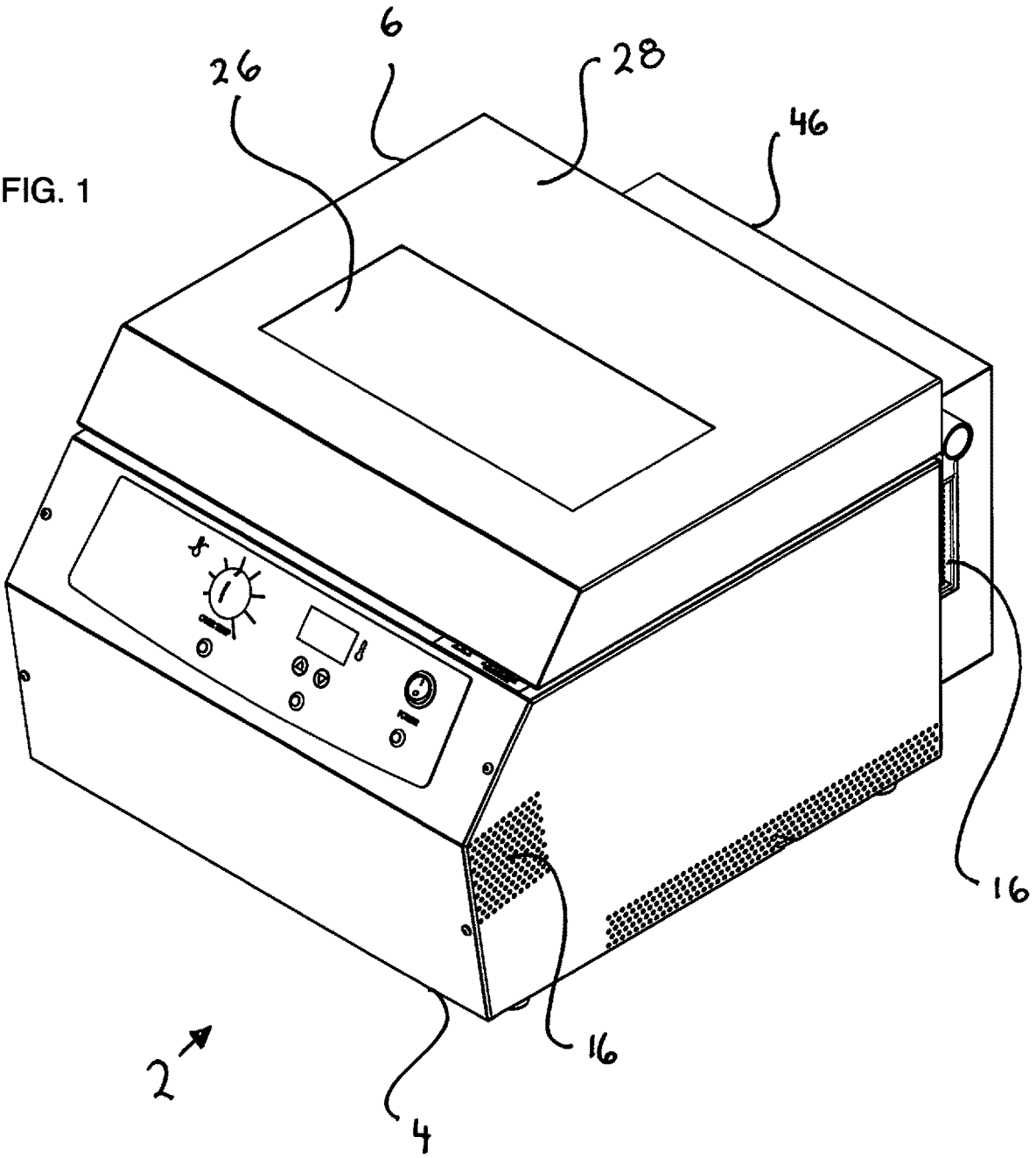
FIG. 1 is a front perspective view of the air jacketed bead bath.
Figure 2:
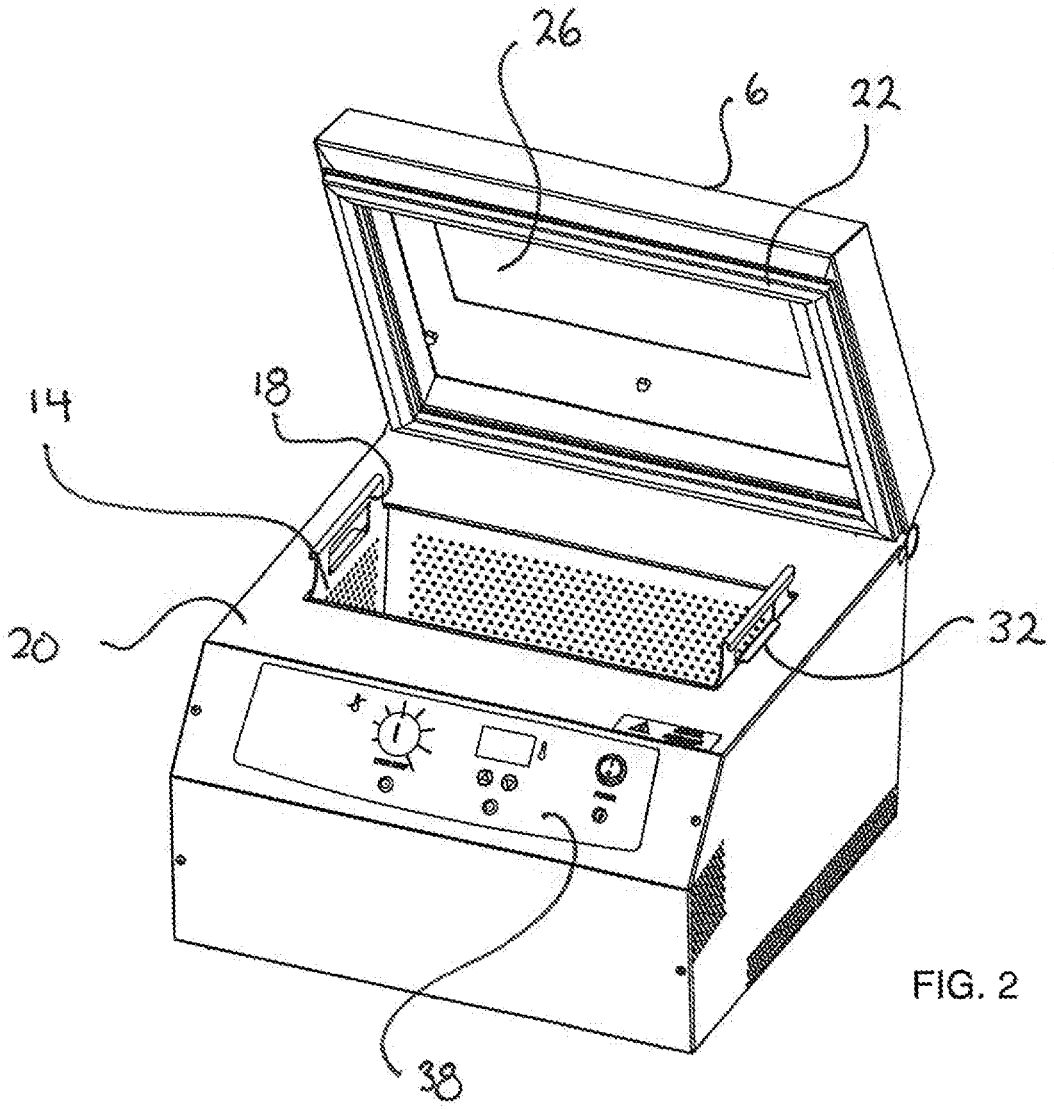
FIG. 2 is a front perspective view of the air jacketed bead bath with its top cover raised.
Figure 3:
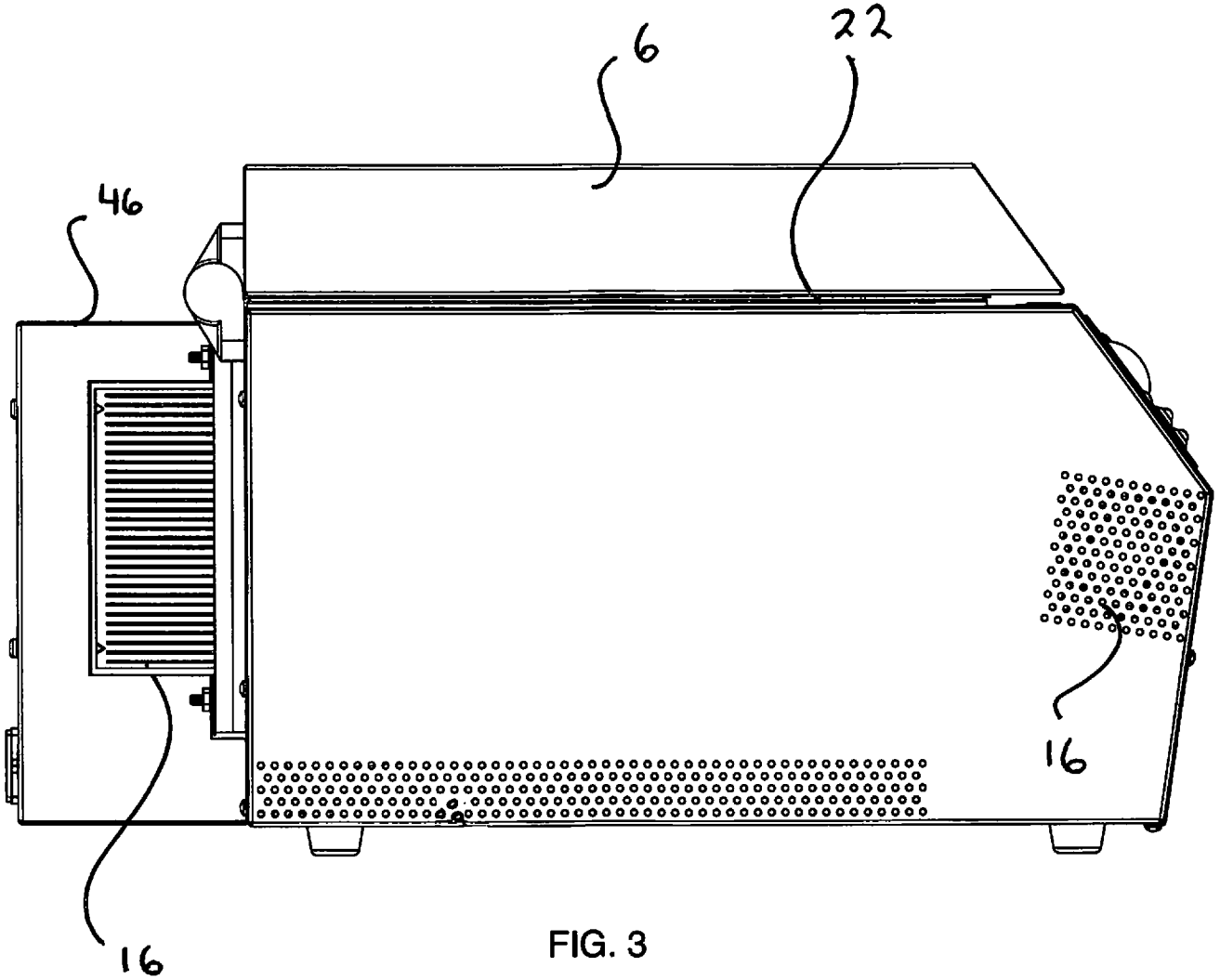
FIG. 3 is a side view of the air jacketed bead bath.
Figure 4:
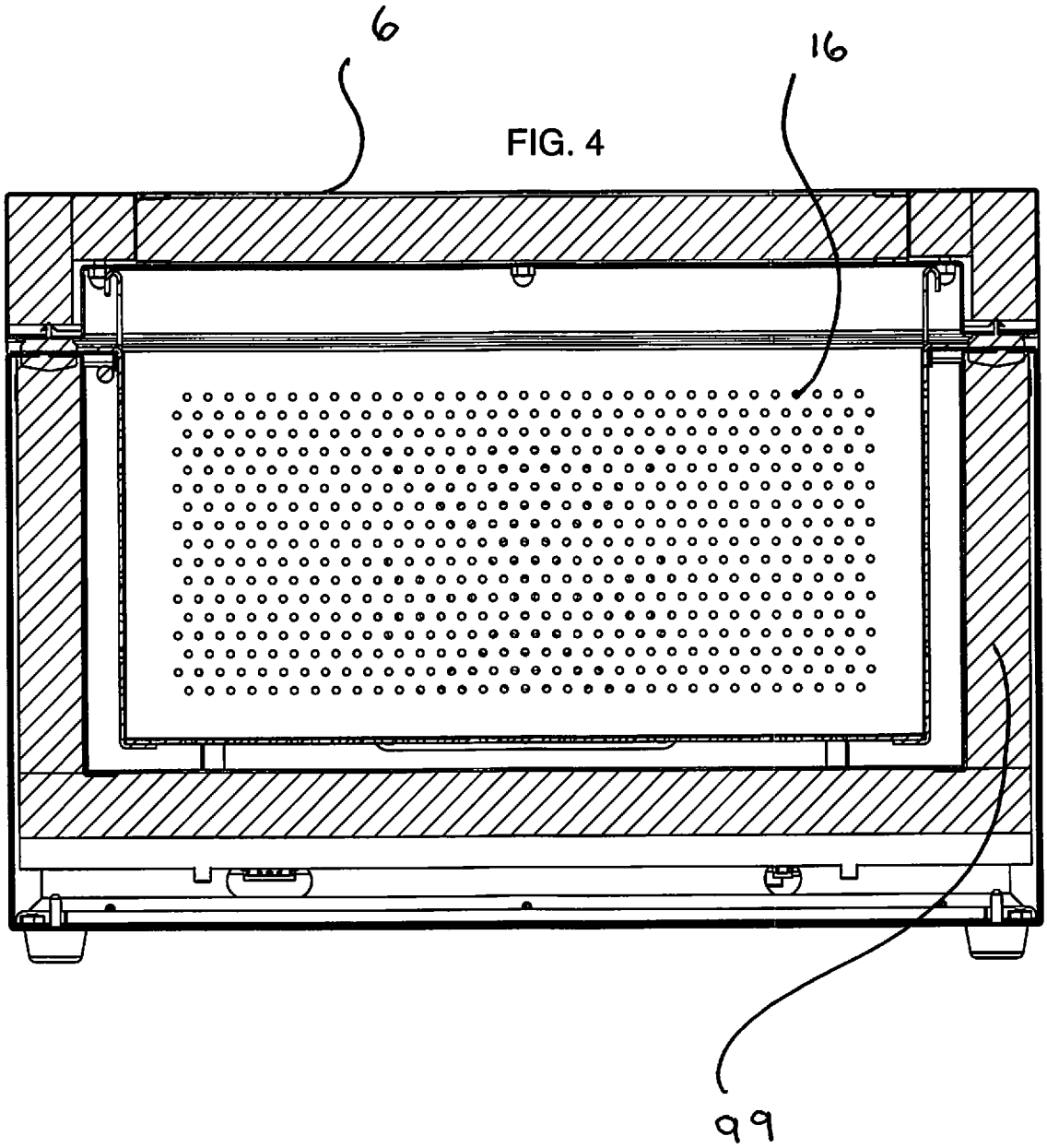
FIG. 4 is a side cross sectional view of the air jacketed bead bath.

Looking at FIGS. 1-3, the general design and layout of the air jacketed bead bath can best be seen. The bead bath 2 is an enclosure 4 with a hinged lid 6. The enclosure is preferably made of 301 stainless steel or cold rolled steel powder coated panels. The enclosure 4 with the lid 6 closed, defines three separate spaces, a control volume 8, an air jacket 10 and an electronics cavity 12. On the back of the enclosure 4 is a Peltier shroud 46. In simplest terms, air brought to the appropriate temperature in the air jacket 10 is circulated through the perforations 16 in the bead basket 14 to pass through the solid media (not shown, but preferably a bed of aluminum shot beads) and maintain it at the desired, preset temperature.

The bead basket 14 has four sides and a bottom each made of planar, aluminum plates with equally spaced perforations therethrough. In alternate embodiments the basket 14 may be made of a different material such as copper, chosen for its antimicrobial properties. The bead basket 14 holds the aluminum shot and defines the control volume 8. It has an open top face and a pair of handles 18 to remove the basket 14 for cleaning. The top face 20 of the enclosure 4 is planar sheet of ferromagnetic steel such that the lid 6 with its magnetic outer sealing gasket 22 can securely seal the enclosure 4 airtight. The lid 6 has a hinge 24 connected to the rear of the enclosure 4 that allows the lid 6 to pivot completely backwards and out of the way for the removal of the basket or insertion of samples into the bead of beads. The lid has a clear window 26 on it top face 28 to allow one to ascertain what is in the bead of aluminum shot without opening the lid 6 and disturbing the controlled climate therein. The lid 6 has a top layer of insulation 30 (preferably polyurethane foam) contained therein its volume to minimize heat losses from the enclosure 2 to the ambient outside air.

The bead basket 14 has a pair of suspension hooks 32 located below the handles 18 that extend from the sides of the basket 14 beyond the dimensions of the opening into the enclosure 4. In this way, the basket 14 hangs suspended from the top face 20 of the enclosure into the air jacket 10 of the enclosure 4 but does not touch the sloped floor 34 of the enclosure 4. This enables the flow of heated air from the air jacket 10 to circulate through both the sides and the bottom of the basket 14, maintaining the aluminum shot at its desired temperature. The area where the outer sealing gasket 22 contacts the top face 20 of the enclosure is beyond where the suspension hooks 32 contact the top face 30.

Figure 5:
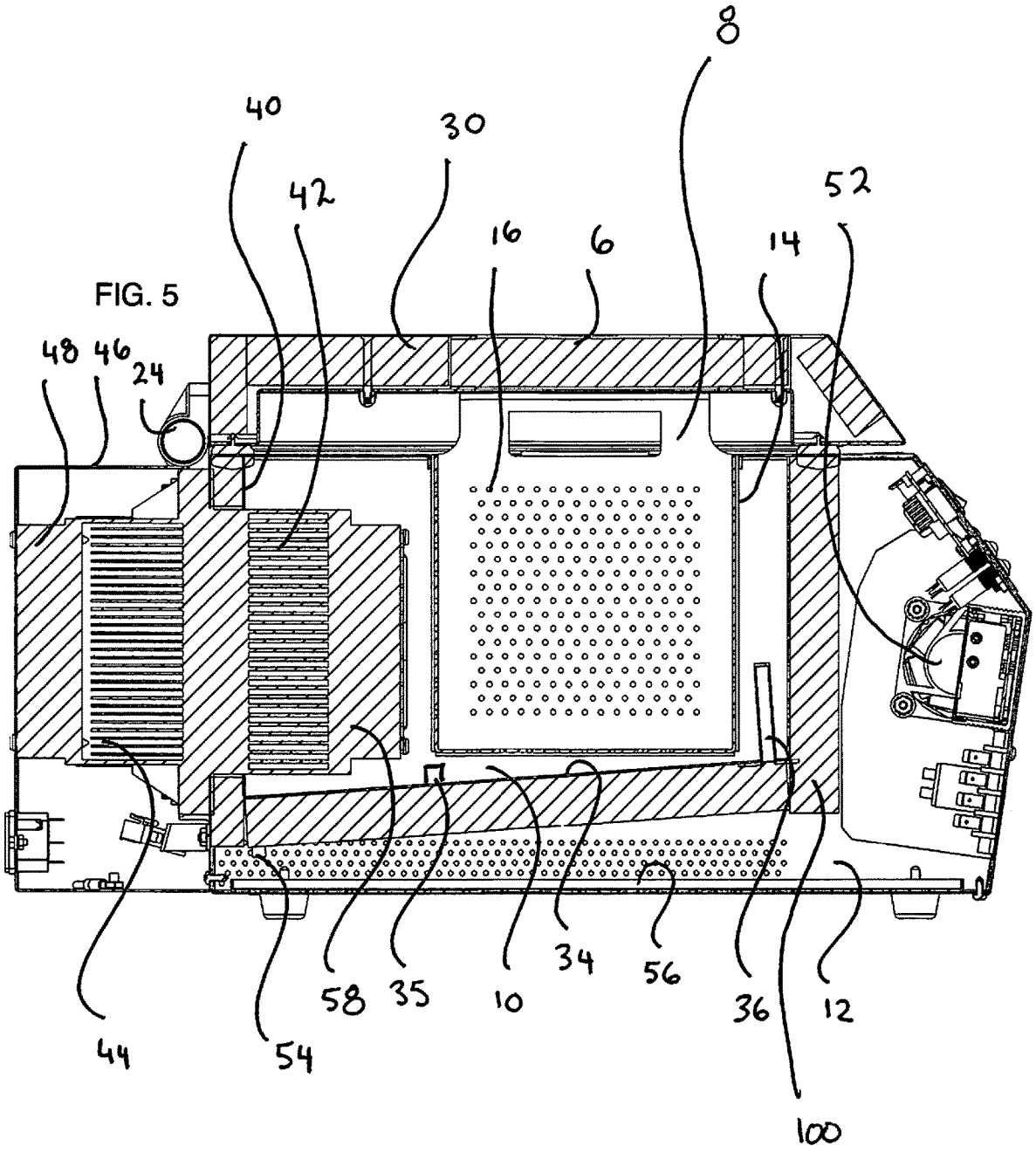
FIG. 5 is a rear view of the air jacketed bead bath.
Figure 6:
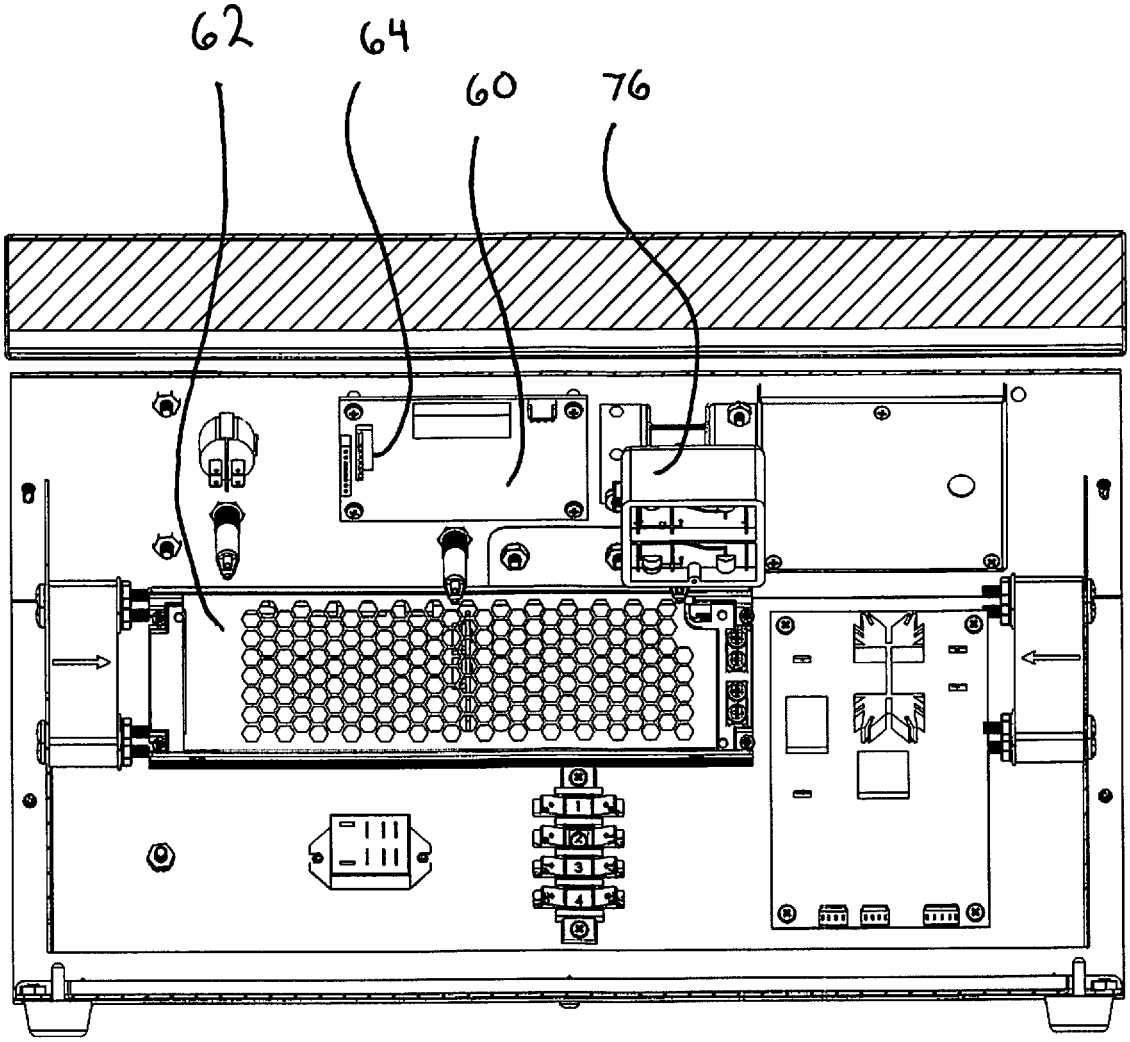
FIG. 6 is a back view of the front face of the air jacketed bead bath.

The air jacket 10 is an empty cavity that has a barrier of insulation directly behind all its side walls 99, front wall 100, back wall 40 and sloped floor 34. There is a first temperature sensor 35 and a second temperature sensor 36 extending upward from the sloped floor 34 and operationally connected to the control assembly 38. The second temperature sensor 36 is of an oil-filled capillary design that opens a set of mechanical contacts to cut the power to the Peltier device upon reaching a high temperature cutoff as set by the overtemperature cutout selector 74. The first temperature sensor is of an RTD type. Through the back insulated wall 40 of the air jacket 10 extends a Peltier device 42 that is operably connected to the control assembly 38. The Peltier device 42 transfers heat from one finned side to the other finned side, depending on the direction of the DC current flowing through it. Generally, it is positioned such that the finned heat rejection side 44 extends into the Peltier shroud 46 at the back of the enclosure 4. (See FIG. 5) There is an exhaust circulating fan 48 therein that moves the warmed or chilled rejected air from the Peltier shroud 46 to the outside through perforations 16 in the back face 50 of the Peltier shroud 46.

The floor 34 of the air jacket 10 is sloped to the rear of the enclosure 4 to allow any condensate that forms inside the air jacket 10 or the control volume 8 to run down the sloped floor 34 and out the drain 54 into the condensate pan 56 at the bottom of the electronics cavity 12. Once in the electronics cavity, the heat therein from the electronics plus the action of the two cooling fans 52 will evaporate this condensate. Note, there are perforations 16 in the sides of the enclosure 4 that allow for flow across the condensate pan 56 and out of the enclosure 4. (See FIG. 3) With this configuration there is a slightly negative pressure with respect to atmospheric pressure in the electronics cavity such that no unconditioned air infiltrates into the air jacket 10.

In front of the Peltier device 42, which is centrally located in the air jacket 10, is a main circulating fan 58 that circulates the air in the air jacket 10 and the basket 14 across the heat transfer fins of the front side of the Peltier device 42. This main circulating fan 58 runs constantly. The Peltier device 42 is also powered constantly although the voltage is continually adjusted between its operating DC voltages+24 to −24 volts to keep the air in the air jacket 10 at the temperature set in the control assembly 38. The microprocessor 60 in the control assembly 38 (See FIG. 5) signals the voltage converter 62 to present the appropriate DC voltage to the Peltier device 42 based on what the control temperature is, set at the temperature control unit 64 and the temperature the first temperature sensor 35 in the air jacket sees.

Figure 7:
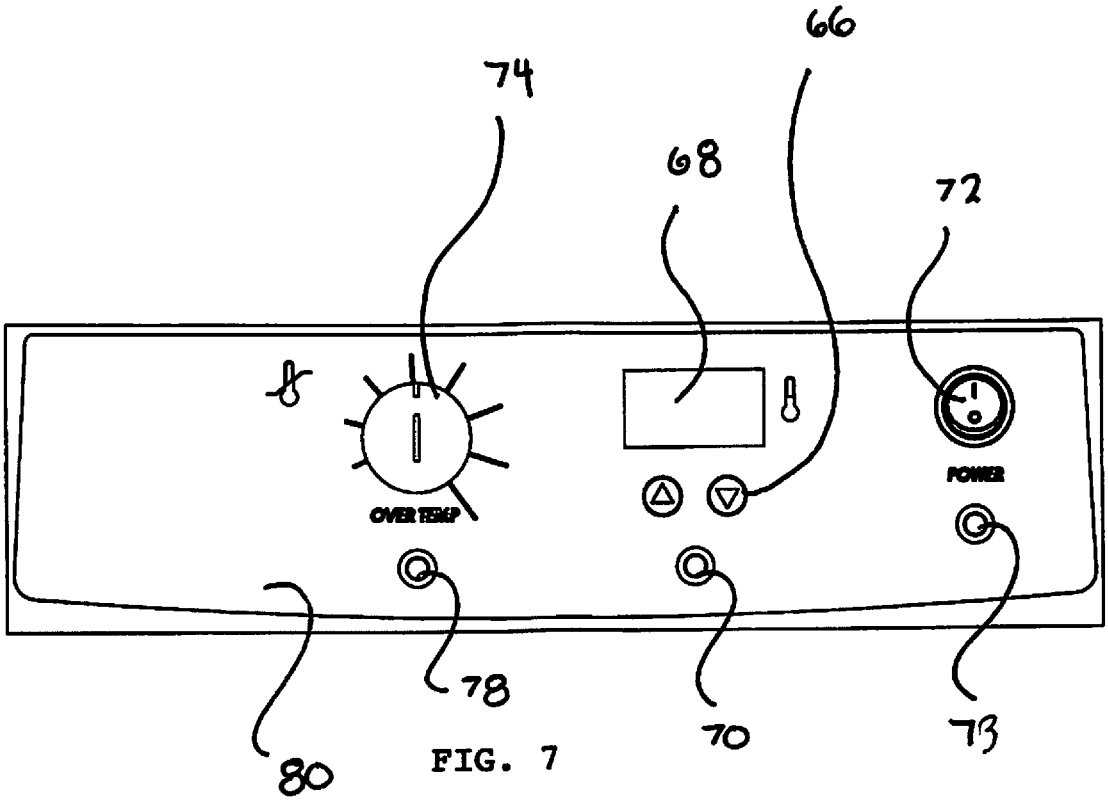
FIG. 7 is a front view of the control panel for the air jacketed bead bath.

The front panel 80 of the control assembly 38 has the temperature control unit 64, the power switch 72 and indicator light 73, and the overtemperature cutout selector 74. The temperature control unit has a pair of adjusting buttons 66 as well as a digital display 68. (FIG. 7) The magnitude of the DC voltage passing across the Peltier device 42 is indicated by the speed of the flashing of the heat indicating light 70. It does not show direction of the current flow, just the magnitude of the voltage. The overtemperature cutout selector 74 sets at what temperature seen by the second temperature sensor 36 in the air jacket 10 will open the contacts on the Peltier device cutout relay 76 to interrupt the power to the Peltier device 42 in the air jacket 10. This is seen on the failure of the Peltier device 42 or upon the insertion of very hot samples into the bed of beads. There is also an overtemperature indicating light 78 that indicates on the front panel when the cutout relay 76 has been actuated. Generally, the Peltier device 42 is always powered to compensate for any deviation from the set air jacket temperature because of over temperature samples in the bed of beads or leakage across the insulation around the lid 6 and the air jacket walls and floor.

The electronics cavity 12 merely houses the control assembly 38, the condensate pan 56 and the twin circulating fans 52. Because of the heat generated by the microprocessor 60 and voltage convertor 62, and the other electronic components of the control assembly could exceed that of the air jacket 10 the twin circulating fans run continually as well to exhaust the warm air out of the electronics cavity 12 through the perforations in the walls of the enclosure 4.

Figure 8:
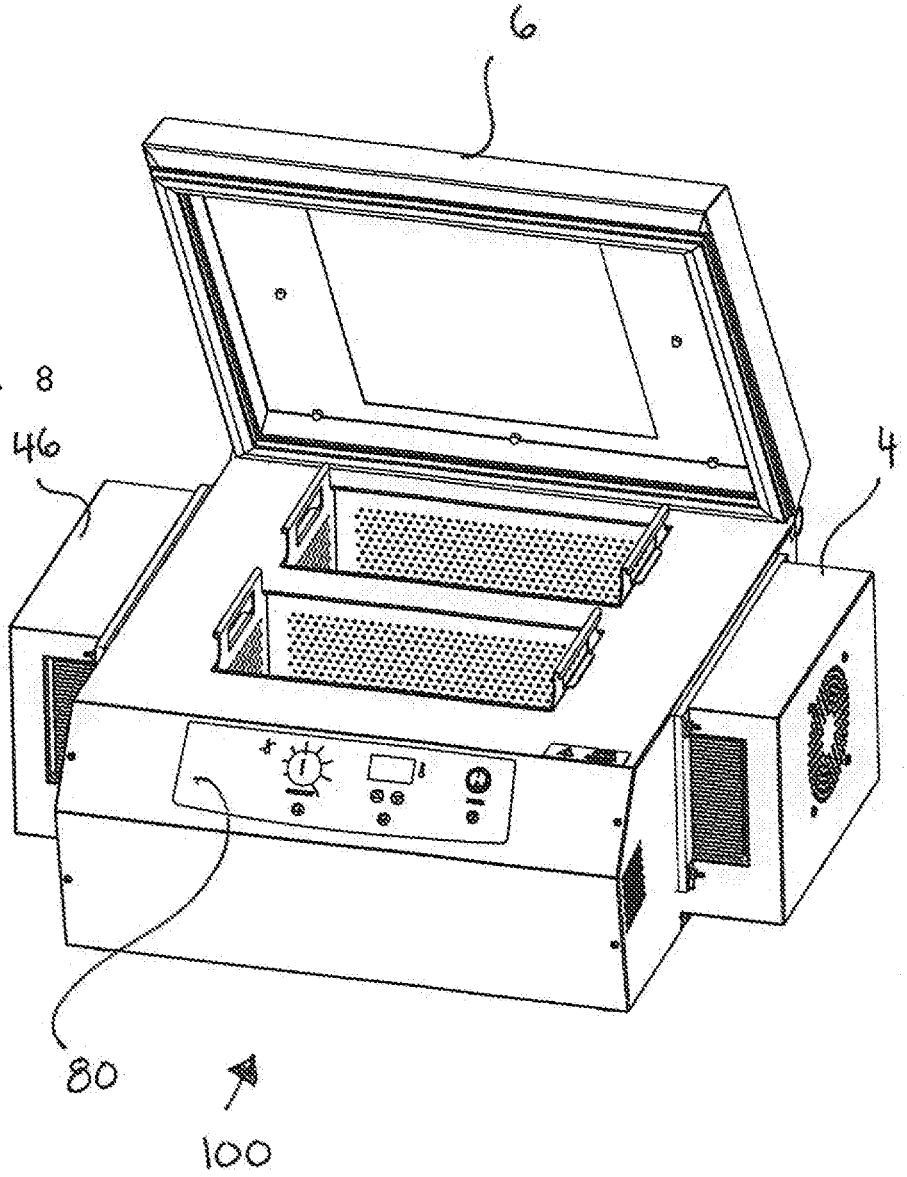
FIG. 8 is a front perspective view of an alternate embodiment air jacketed bead bath with the cover raised.

FIG. 8 shows a larger version alternate embodiment air jacketed bead bath 100. Here, the operation is identical but the scale and number of components to accomplish this is larger. It can be seen that there are two Peltier devices and two Peltier shrouds 46, two bead baskets 14, and one control panel 80. The general design and internal layout is the functional equivalent.

In operation, the lid 6 is opened and the bead basket/s 14 are filled with aluminum shot. The lid 6 is closed such that an airtight seal is made between the lid 6 and the top face 20 of the enclosure 4 with the magnetic outer sealing gasket 22. The unit is turned on with the power switch 72 such that the power indicator light 73 illuminates. The adjusting buttons 66 are manipulated until the digital display 68 reads the preset temperature. The main circulating fan 58, the twin circulating fans 52 and the exhaust fan 48 as well as the power to the Peltier device 42 are all now operating. The microprocessor 60, sensing the temperature seen by the first temperature sensor 35 in the air jacket 10 adjusts the power convertor 62 to provide the correct voltage and polarity to the Peltier device to raise or lower the temperate in the air jacket 10 to that set by the temperature control unit 64. The heat indicating light 70 blinks at the same ratio as the maximum amount of the voltage applied although it does not indicate the direction of the voltage. (I. E. The light illuminates 100 percent on for + or −24 volts and 50% flashing for + or −12 volts.) The air is circulated by the main circulating fan 58 through the air jacket 10 and the control volume 8 to maintain the aluminum shot at the desired temperature. With the current state of Peltier temperature control, it is possible to maintain temperature of the bead bath between 2 and 70 degrees C. If the temperature as seen by the second temperature sensor exceeds the setpoint of the temperature selected on the overtemperature cutout selector the Peltier device cutout relay will actuate and shut off the power to the Peltier device.

While certain features and aspects have been described with respect to exemplary embodiments, one skilled in the art will recognize that numerous modifications are possible.

Having thus described the invention, what is claimed as new and desired to be secured by Letters Patent is as follows:

1. An air jacketed bead bath for regulating the temperature of a plurality of thermally-conductive beads, comprising:

a multi cavity enclosure, said enclosure having a control volume, an air jacket cavity, and an electronics cavity;

wherein said enclosure has a front face, a back face, a bottom face, an insulated top face and two side faces;

an openable, insulated lid attached to said insulated top face;

a bead basket configured to hold the plurality of thermally-conductive beads, made of four conjoined perforated side plates extending from a perforated bottom plate, said bead basket removably suspended from said insulated top face so as to reside in said air jacket cavity, wherein a volume bounded by said bead basket and said insulated lid defines said control volume;

wherein said air jacket cavity is separated from said electronics cavity by an insulated sloped bottom with a drain orifice from which extends an insulated front wall, and an insulated back wall connected by two insulated side walls;

a Peltier shroud affixed to said back face of said enclosure;

a Peltier device extending through said insulated back wall, between said air jacket cavity and said Peltier shroud;

a main circulating fan mounted in said air jacket cavity between a front side of said Peltier device and said control volume;

a temperature sensor mounted in said air jacket cavity;

a condensate pan residing on a bottom of said electronics cavity and at least one cooling fan affixed therein said electronics cavity, wherein said two side faces of said multi cavity enclosure have perforations therethrough for the exit of air circulated in said electronics cavity;

an exhaust circulating fan mounted in said Peltier shroud for exhausting air from a back side of said Peltier device through a set of orifices formed through said Peltier shroud;

a control assembly mounted in said electronics cavity and operationally connected to said Peltier device, said main circulating fan, said temperature sensor, said two cooling fans and said exhaust fan.

2. The air jacketed bead bath of claim 1 wherein said top face is made of a ferromagnetic material and said openable lid has a magnetic gasket affixed about a perimeter thereof for sealing of said openable lid to said top face of said enclosure.

3. The air jacketed bead bath of claim 2 wherein said openable lid has a transparent window viewable into said control volume thereon.

4. The air jacketed bead bath of claim 1 wherein said control assembly comprises:

a power switch and power indicator light connectable to an AC power source;

a microprocessor;

a voltage convertor connected to said microprocessor and said Peltier device;

a temperature control unit with adjusting controls and digital temperature display, said temperature control unit connected to said temperature sensor and said microprocessor.

5. The air jacketed bead bath of claim 4 further comprising:

a second temperature sensor;

a Peltier device cutout relay;

an overtemperature cutout selector connected to said second temperature sensor and said Peltier device cutout relay to shut off the power to said Peltier device when a high temperature is seen in said air jacket cavity.

6. The air jacketed bead bath of claim 5 further comprising:

a heat indicating light;

an overtemperature indicating light.

* * * * *